US005958142A

United States Patent [19]

Rousseau

[11] Patent Number: 5,958,142

[45] Date of Patent: Sep. 28, 1999

[54] METHOD OF REGENERATING ION EXCHANGE RESINS IN THE PROCESS OF DECALCIFICATION OF SUGAR FACTORY JUICES

[75] Inventor: Gérard Rousseau, Saint Quentin, France

[73] Assignee: Generale Sucriere, France

[21] Appl. No.: 08/927,344

[22] Filed: Sep. 11, 1997

[30] Foreign Application Priority Data

Sep. 18, 1996 [FR] France ..... 96 11373

[51] Int. Cl.[6] ..... C13J 1/06

[52] U.S. Cl. ..... 127/46.2

[58] Field of Search ..... 127/46.2

[56] References Cited

U.S. PATENT DOCUMENTS 5,443,650 8/1995 Saska et al. ..... 127/46.2
5,554,227 9/1996 Kwok et al. ..... 127/58

FOREIGN PATENT DOCUMENTS 0016992 10/1980 European Pat. Off. .
0032263 7/1981 European Pat. Off. .
1404591 5/1965 France .

OTHER PUBLICATIONS

Zeitschrift Fur Die Zuckerindutrie, vol. 25, No. 9, Sep. 20, 1975: pp. 493–501.

*Primary Examiner*—David Brunsman
*Attorney, Agent, or Firm*—Morgan & Finnegan, L.L.P.

[57] ABSTRACT

In a method of decalcification of purified sugar factory juices from a sugar factory process the juices, containing calcium ions, are sent onto an $Na^+$ or $K^+$ form strongly cationic ion exchange resin where the calcium ions are replaced with sodium and/or potassium ions. The ion exchange resin is then subject to regeneration (or washing) with dilute molasses. In a first variant of the method, the molasses is sent to the ion exchange resin in a cocurrent configuration. In a second variant, the molasses is sent to the ion exchange resin in a countercurrent configuration. This method can be used in a process to manufacture sugar from sugar beet or sugar cane.

18 Claims, 1 Drawing Sheet

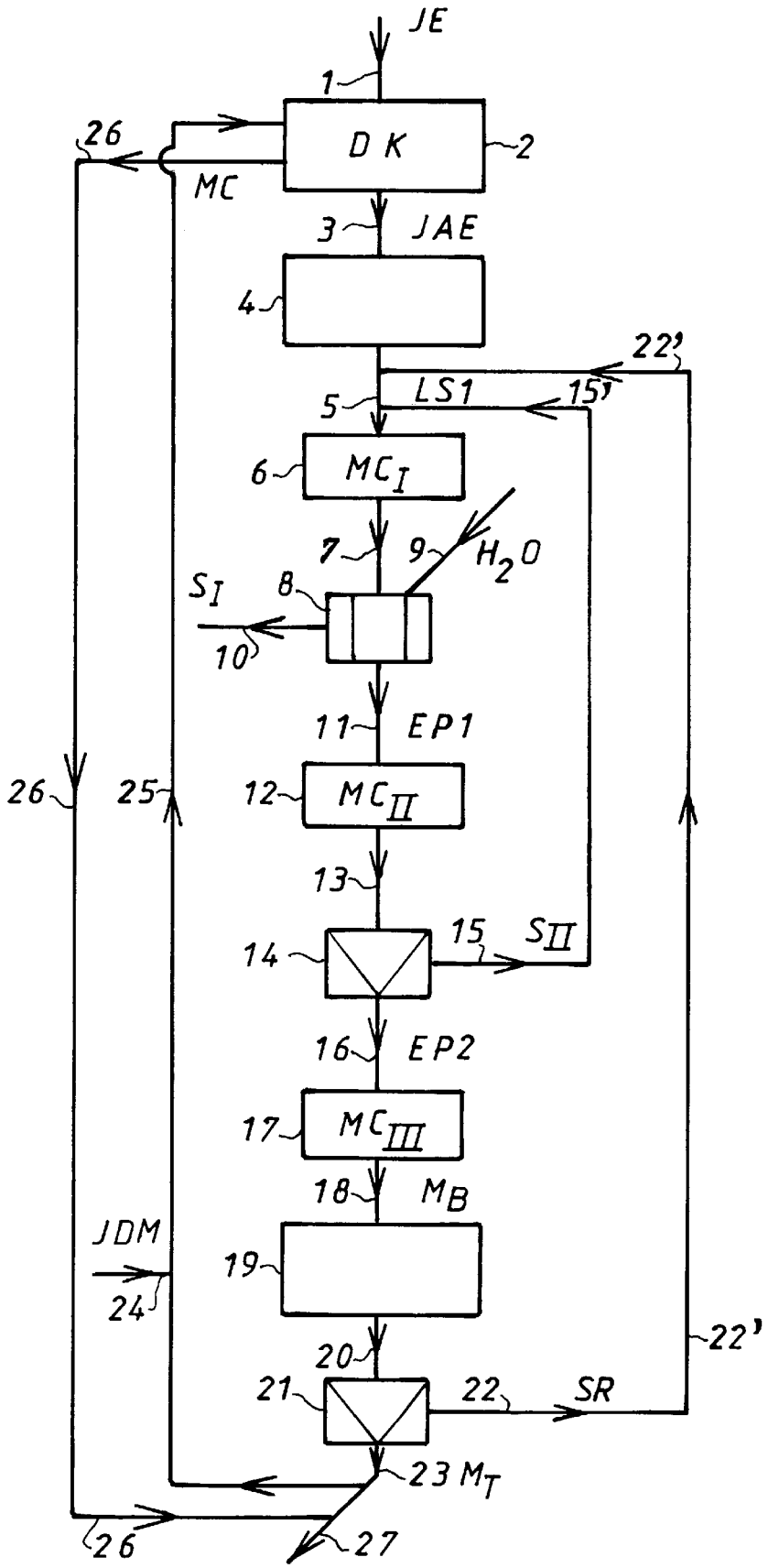
JE
1
DK
2
26
MC
3
JAE
4
22'
5
LS1
15'
6
MC_I
7
9
H2O
SI
8
10
11
EP1
26
25
12
MC_II
13
14
15
SII
16
EP2
17
MC_III
18
MB
JDM
19
24
20
22'
21
22
SR
23 MT
26
27

METHOD OF REGENERATING ION EXCHANGE RESINS IN THE PROCESS OF DECALCIFICATION OF SUGAR FACTORY JUICES

BACKGROUND OF THE INVENTION

1. Field of the Invention

The present invention concerns a method of sweetening an aqueous sugar-containing juice containing sugar and calcium ions and is more particularly concerned with a method of regenerating ion exchange resins in the process of decalcification of sugar factory juices.

2. Description of the Prior Art

During the processes employed in the manufacture of sugar, the juice obtained by diffusion from sugar beet converted into cossettes is treated with lime. The spent cossettes are pressed to produce pulp. The lime introduced into the juice is converted into calcium carbonate by introducing carbon dioxide. The calcium carbonate is eliminated by filtration. However, this elimination is only partial and a certain quantity of calcium compound remains dissolved in the juice in the form of soluble calcium salts. These calcium salts have a certain degree of solubility which decreases if the concentration of dry materials increases, which occurs during the evaporation and crystallization steps. On precipitating, these calcium salts deposit tartar on the equipment and reduce the coefficient of thermal transfer, which causes partial disruption to the equilibrium of the economics of sugar factory. Furthermore, they cause turbidity in the crystallized sugar obtained during the process.

Decalcification is therefore needed to keep the equipment clean and to obtain sugars of quality, that is to say without turbidity. The calcium ions are exchanged by means of ion exchange resins for sodium and/or potassium ions and the resin is then regenerated. Regeneration was initially effected with brine, NaCl, but this method of regeneration has now been abandoned in most countries since it produces waste water charged with chlorides.

Two types of regeneration are currently used, the Akzo or NRS process and the Gryllus process.

The Akzo process, consisting in regeneration using soda, involves a considerable expenditure of soda and an increase in the coloration of the clarified juices.

In the Gryllus process, regeneration is effected using Green Syrup II. The drawbacks of the Gryllus process are third strike precipitation of calcium salts, Standard Liquor 1 (LS1) recycling and turbidity in the first strike sugar.

The present invention overcomes the problems of prior art regeneration techniques.

In the method of the present invention molasses is used to regenerate ion exchange resins of the sugar factory juice decalcification process.

SUMMARY OF THE INVENTION

The present invention therefore provides a method of decalcification of purified sugar factory juices from a sugar factory process wherein said juices, containing calcium ions, are sent onto an $Na^+$ or $K^+$ form strongly cationic ion exchange resin where the calcium ions are replaced with sodium and/or potassium ions and wherein said ion exchange resin is then subject to regeneration (or washing), in which method said regeneration of said ion exchange resin is effected with dilute molasses.

This molasses is advantageously a portion of the molasses obtained during the sugar factory processing.

If the installation includes a distillery, all the products leaving the decalcification process and used for regeneration are sent direct to the distillery. There is no purification eluate recycling. In this case the first variant described below is advantageously used.

Conversely, if the installation does not include a distillery, the dilute fractions are used to dilute the molasses (for regeneration). In this case the second variant described below is preferably used.

In a first variant of the invention the molasses is sent to the regeneration step in a cocurrent configuration.

In the first variant of the present invention, the molasses is preferably diluted to about 70 to 80 Brix (percent of dry materials), more preferably to about 76 Brix, before it is sent to the decalcification step to regenerate the ion exchange resin.

In this first variant of the present invention, the molasses is advantageously heated to a temperature of about 80° C. to 90° C., more preferably to about 85° C., before it is sent to the decalcification step to regenerate the ion exchange resin.

In the first variant of the invention, the ion exchange resin is regenerated when the resin is dry, i.e. when the bed of resin has been drained and is therefore dry. An ion exchange resin is said to be "dry" when it does not contain any interstitial liquid (water or, in this case, juice).

As far as we are aware, ion exchange resins have not been regenerated when dry in the prior art. It has therefore been necessary to overcome a major prejudice in applying the above features of the first variant of the present invention.

In accordance with another advantageous feature of the first variant of the present invention, a cake of molasses is produced which is then sent onto the resin in order to eliminate the dilute juice contained in the resin with the minimum of mixing, i.e. of dilution.

In accordance with a further advantageous feature of this first variant of the invention, after regeneration, the resin is dried by total draining of the resin tank and the resin is washed dry with a cake of clarified juice.

The calcified molasses used to regenerate the ion exchange resin from the decalcification step is mixed with the process molasses, i.e. the molasses, to obtain a concentration equal to about 80% of dry materials, and is sent to storage.

In a second variant of the invention, the molasses is sent into the regeneration step in a countercurrent configuration.

In the second variant of the present invention the molasses is preferably diluted to about 60 Brix to 65 Brix, more preferably to about 62 Brix, before it is sent to the decalcification step to regenerate the ion exchange resin.

In this second embodiment of the present invention, the molasses is advantageously sent at a temperature of about 50° C. to 60° C., more preferably at about 55° C., before it is sent to the decalcification step to regenerate the ion exchange resin.

Before regeneration proper, the resins are subjected to total draining and are then washed dry with a small quantity of water (about 0.2 BV).

In the second variant of the invention, the ion exchange resin is washed when the resin is dry, that is to say when the bed of resin has been drained and is therefore dry. An ion exchange resin is said to be "dry" when it does not contain any interstitial liquid (water).

As far as we are aware, ion exchange resins have not been regenerated when dry in the prior art. It has therefore been necessary to overcome a major prejudice in applying the above features of the second variant of the present invention.

In accordance with another advantageous feature of this second variant of the invention, after regeneration (washing), the resin is dried by total draining of the resin tank and the resin is washed dry with several successive cakes of water.

The calcified molasses used to regenerate the ion exchange resin of the decalcification step is mixed with the process molasses, i.e. the molasses, to obtain a concentration equal to about 80% of dry materials, and is sent to storage.

If desired, it is possible to eliminate the calcium salts from the calcified molasses produced by the regeneration of the ion exchange resin by simply carbonating said molasses and separating from it the calcium carbonate formed.

The method of the present invention can be used equally well in the manufacture of sugar from sugar beet or from sugar cane.

The present invention will now be described with reference to the accompanying drawing.

BRIEF DESCRIPTION OF THE DRAWINGS

The accompanying drawing is a schematic representation of a sugar factory process constituting one example of the first and second variants of the present invention.

DETAILED DESCRIPTION OF THE PREFERRED EMBODIMENTS

In the first variant, the clarified juices JE from the filtration steps (of which there are generally two), containing sodium, potassium and calcium ions, are sent at 1 to the decalcification step DK 2. During the decalcification step DK the calcified juices pass over an ion exchange resin (not shown). The juices from which the calcium ions have been removed but still containing sodium and potassium ions leaving the decalcification at 3 contain about 15% of dry materials. These juices before evaporation are designated JAE. The JAE are sent at 3 into a multiple stage (multistage) evaporation step 4 with several stages, generally five stages (not shown), from which emerges at 5 a syrup containing about 72% to 74% of dry materials. This syrup receives the third strike, and possibly second strike, remelt syrups, as will be explained below, to constitute the Standard Liquor 1 (LS1), which will be fed to the first crystallization strike. The LS1 is sent at 5 into a first strike cooking apparatus 6, containing the massecuite 1 ($MC_I$). The $MC_I$ leaving the first strike cooking apparatus 6 at 7 is sent into a discontinuous first strike centrifuge 8 where water $H_2O$ is added to it at 9. On leaving the first strike centrifuge 8 at 10, first strike sugar I or $S_I$, is recovered, together with $MC_I$ mother juice, designated Green Syrup I (EP1) at 11. This EP1 also constitutes the LS2 (Standard Liquor 2). The EP1 (or LS2) is sent to a second strike cooking apparatus 12 containing the massecuite II ($MC_{II}$). The $MC_{II}$, leaving the second strike cooking apparatus 12 at 13 is sent into a continuous second strike centrifuge 14. Second strike sugar $S_{II}$, is recovered at the outlet 15 of the second strike centrifuge 14, together with $MC_{II}$ mother juice, designated Green Syrup II (EP2) at 16. The second strike sugar $S_{II}$ is recycled at 15' into the Standard Liquor LS1. The EP2 is sent at 16 into a third strike cooking apparatus 17 containing the massecuite III ($MC_{III}$). The $MC_{III}$ leaving the third strike cooking apparatus 17 at 18 is sent to a vertical crystallizer unit 19, of which there are generally three (not shown individually), and then at 20 to a continuous centrifuge 21. Raw sugar SR is recovered from the outlet of the continuous centrifuge 21 at 22 and sent to the Standard Liquor 1 at 22' and to the molasses $M_T$ at 23.

In the first variant of the present invention a portion of the molasses $M_T$, obtained at between 82 Brix and 86 Brix, generally at about 84 Brix, is diluted with molasses dilution juices JDM arriving at 24 from the washing of the ion exchange resin to about 35 Brix and sent at 25 to the decalcification step 2 to regenerate the ion exchange resin in a cocurrent configuration. The calcified molasses $M_C$ leaving the decalcification 2 at 26 after regenerating the ion exchange resin is mixed with the molasses $M_T$ to obtain molasses having a concentration exceeding about 78% to 80% of dry materials which is sent to storage at 27.

The theoretical regeneration yield $R_t$, i.e. the ratio of the [regeneration action equivalent] to the [eliminated $Ca^{++}$ equivalent] is 1.34. Table 1 hereinafter indicates the practical values obtained for the practical regeneration yield $R_p$ in the method of the present invention and the various prior art methods.

TABLE 1

| Process | $R_p$ |
|---|---|
| NaCl | 5–10 |
| Gryllus | 4–7 |
| Akzo | 2.0–3.0 |
| Present invention (cocurrent) | 4.0 |

In the second variant, the clarified juices JE from the filtration steps (of which there are generally two), containing sodium, potassium and calcium ions, are sent at 1 to a decalcification step DK 2. During the decalcification step DK, the calcified juices pass over an ion exchange resin (not shown). The juices leaving the decalcification at 3, from which the calcium ions have been removed but still containing sodium and potassium ions, contain about 15% of dry materials. These juices before evaporation are designated JAE. The JAE are sent at 3 into an evaporation step 4 with several stages, generally five stages (not shown), from which exits at 5 a syrup containing about 72% to 74% of dry materials. This syrup receives the third strike, and possibly second strike, remelt syrups, as explained below, to constitute the Standard Liquor 1 (LS1) that will be fed to the first crystallization strike. The LS1 is sent at 5 into a first strike cooking apparatus 6 containing the massecuite I ($MC_I$). The $MC_I$ leaving the first strike cooking apparatus 6 at 7 is sent into a discontinuous first strike centrifuge 8 to which water $H_2O$ is added at 9. At the outlet 10 of the first strike centrifuge 8 first strike sugar, Sugar I or $S_I$, is recovered, together with $MC_I$ mother juice, designated Green Syrup (EP1) at 11. This EP1 also constitutes the LS2 (Standard Liquor 2). The EP1 (or LS2) is sent to a second strike cooking apparatus 12 containing the massecuite II ($MC_{II}$). The $MC_{II}$, leaving the second cooking apparatus 12 at 13 is sent into a continuous second strike centrifuge 14. Second strike sugar $S_{II}$ is recovered at the outlet 15 of the second strike centrifuge 14, together with $MC_{II}$ mother juice, designated Green Syrup II (EP2) at 16. The second strike sugar $S_{II}$ is recycled at 15' into the Standard Liquor LS1. The EP2 is sent at 16 into a third strike cooking apparatus 17 containing the massecuite III ($MC_{III}$m). The $MC_{III}$ leaving the third strike cooking apparatus at 18 is sent to a vertical crystallizer block 19, of which there are generally 3 (not shown individually), and then at 20 to a continuous centrifuge 21. Raw sugar SR is recovered at the outlet from the continuous centrifuge 21 at 22 and sent to the Standard Liquor 1 at 22' and to the molasses $M_T$ at 23.

In the second variant of the present invention, a portion of the molasses $M_T$, obtained at between 82 Brix and 86 Brix, generally at about 84 Brix, is diluted with molasses dilution juices JDM arriving at 24 from the washing of the ion exchange resin and sent at 25 to the decalcification step 2 for regenerating the ion exchange resin in a countercurrent configuration. The calcified molasses $M_C$ leaving the decalcification 2 at 26 after regenerating the ion exchange resin is mixed with the molasses $M_T$ to obtain molasses having a concentration exceeding about 78% to 80% of dry materials that is sent to storage at 27.

The theoretical regeneration yield $R_t$, i.e. the ratio of the [regeneration action equivalent] to the [eliminated $Ca^{++}$ equivalent] is 1.34. Table 2 below indicates the practical values obtained for the practical regeneration yield $R_p$ in the method of the present invention and the prior art methods.

TABLE 2

| Process | $R_p$ |
|---|---|
| NaCl | 5–10 |
| Gryllus | 4–7 |
| Akzo | 2.0–3.0 |
| Present invention (countercurrent) | 2.0–3.0 |

The following examples describe the invention in a non-limiting way.

EXAMPLE 1 (concerning the first variant)

The bed of decalcification ion exchange resin containing the resin, with a resin trap in the form of balls, is contained in a tank;

a) To enable effective stirring without loss of resin to the resin trap, at the start of regeneration, the tank is partly drained. Air expanded to 2.5 $10^{-2}$ mPa (2.5 bars) is sent into the tank. The partial draining is stopped about 30 cm above the level of the resins;

b) Degassing is then effected to break the pressure in the tank by venting to atmosphere, enabling air at 0.5 $10^{-2}$ mPa (0.5 bar) to enter;

c) Air stirring breaks up the resin and causes the impurities in suspension in the juice and the fine resins (broken or spent) to rise to the surface;

d) A "lift" with JAE is effected to drive out the impurities and fines that accumulate in the upper part of the tank during air stirring;

e) The resin bed is then drained totally. The benefit of total draining is to recover as much as possible of the JAE remaining in the tank, in order to limit for subsequent regeneration the mixing of low-Brix product (JAE) with the high-Brix product (molasses) to minimize the quantity of medium-Brix product (i.e. a product at between about 20 Brix and 80 Brix). It is not desirable to store medium-Brix products with the molasses as there would be conservation problems due to the excessively low final Brix. Moreover, if these medium-Brix products were recycled to the upstream end of the process in large quantities, they could disrupt purification;

f) The tank is then vented to atmosphere to break the pressure following total draining;

g) The crude molasses $M_B$ is diluted with hot JDM at 76 Brix. This molasses is then heated to 85° C. and sent to regeneration;

h) The molasses heated to 85° C. is sent to the top inlet of the tank, in order to constitute a cake. This cake enters the bed of resin progressively. A "piston" effect is obtained, which expels the JAE from the interior of the resin balls and towards the bottom of the tank;

The eluate, consisting of a mixture JAE and molasses, leaves the tank and is collected in a tank of molasses diluted to 55 Brix;

i) After regeneration, the ion exchange resin tank is again drained and degassed. The tank is then filled with juice before sweetening down decalcification (JAD) which expels the molasses trapped in the resin balls towards the bottom of the tank;

j) The eluate leaves to a tank of molasses calcified to 55 Brix;

k) To effect a sweetening down phase, the tank is then fed with JAD. The eluates at up to 35 Brix are collected in a recycled dilute molasses (MDR) tank and then, after a time-delay, to the JDM tank, up to a set point level. The tank is then again fed with the JAD, to 22 Brix.

Phases a), b), c) and d) are then repeated.

EXAMPLE 2 (concerning the second variant)

Phases a) through f) are effected as in Example 1 above. The following phases are then effected:

g) Washing with a small quantity of water (0.2 BV) is done on the dry resin bed for better separation of the JAE from the molasses;

h) The raw molasses MB is diluted with JDM to 62 Brix. This molasses at 55° C. is sent to countercurrent regeneration at a speed of 1.5 BV/h. The volume to be treated is 1.7 BV;

i) After regeneration, the tank of ion exchange resin is again drained and degassed;

j) The resins are then washed four times with 0.18 BV of water. The eluates are collected in the JDM tank;

k) A countercurrent of JAD recovers a dilute fraction (15 Brix) sent to purification. This tank is regenerated and ready for use;

l) the JDM is used to dilute the molasses for regeneration. The excess is used at the third strike for dilution (cooker outlet—to crystallizer) or clarification in centrifuges.

Phases a), b), c) and d) are then repeated.

The skilled person will understand that although the invention has been described and shown by way of specific embodiments, many variants can be envisaged without departing from the scope of the invention as defined in the accompanying claims.

There is claimed:

1. A method of decalcification of purified sugar factory juices from a sugar factory process wherein said juices, containing calcium ions, are sent onto an $Na^+$ or $K^+$ form strongly cationic ion exchange resin where the calcium ions are replaced with sodium and/or potassium ions and wherein said ion exchange resin is then subject to regeneration, in which method said regeneration of said ion exchange resin is effected with dilute molasses diluted to about 60 to 80 Brix.

2. The method of claim 1 wherein said regenerated ion exchange resin is washed yielding molasses dilution juices and said regeneration of said ion exchange resin is effected with said molasses dilution juices.

3. The method of claim 2 in which, after said regeneration, said ion exchange resin is dried before said washing.

4. The method claimed in claim 1 wherein said dilute molasses is a portion of the molasses obtained in said sugar factory process.

5. The method claimed in claim 1 wherein calcified dilute molasses that has been used to regenerate said ion exchange resin is mixed with process molasses to obtain a concentration equal to about 80% of dry materials.

6. The method claimed in claim 1 wherein said dilute molasses is sent onto the ion exchange resin in a cocurrent configuration.

7. The method claimed in claim 6 wherein said dilute molasses is diluted to about 70 Brix to 80 Brix.

8. The method according to claim 6 wherein said molasses is heated to a temperature of about 80° C. to 90° C.

9. The method according to claim 6 wherein said regeneration is effected on said ion exchange resin when dry.

10. The method claimed in claim 6 wherein, for said regeneration, said molasses is sent to said ion exchange resin in the form of cake.

11. The method claimed in claim 6 wherein, after regeneration, said ion exchange resin is dried and is washed dry with clarified juice in the form of cake.

12. The method claimed in claim 1 wherein said dilute molasses is sent to said ion exchange resin in a countercurrent configuration.

13. The method claimed in claim 12 wherein said dilute molasses is diluted to about 60 Brix to 65 Brix.

14. The method claimed in claim 12 wherein said dilute molasses is sent at a temperature of about 50° C. to 60° C.

15. The method claimed in claim 12 wherein, after regeneration, said ion exchange resin is dried and is washed dry with water.

16. The method claimed in claim 12 wherein calcium salts are eliminated from the calcified molasses from the regeneration of the ion exchange resin by carbonating said dilute molasses and separating the calcium carbonate formed.

17. The method of claim 1 wherein the sugar factory juices are derived from sugar beet.

18. The method of claim 1 wherein the sugar factory juices are derived from sugar cane.

* * * * *